United States Patent [19]

Manning

[11] Patent Number: 4,480,244

[45] Date of Patent: Oct. 30, 1984

[54] APPARATUS FOR THE REMOTE CLOSING OF FUSE CIRCUITS

[76] Inventor: Donald R. Manning, 507 Susquehann Ave., Milton, Pa. 17847

[21] Appl. No.: 393,097

[22] Filed: Jun. 28, 1982

[51] Int. Cl.[3] ..... H01H 71/10

[52] U.S. Cl. ..... 337/171; 337/168; 337/174

[58] Field of Search ..... 294/19 R, 20, 21, 22; 81/3.8, 53.1; 337/168, 202, 211, 214, 208, 194, 212, 213, 203, 171, 174, 175

[56] References Cited

U.S. PATENT DOCUMENTS

| | | | |
|---|---|---|---|
| 2,243,528 | 5/1944 | Grinnell | 294/19 R |
| 3,026,391 | 3/1962 | Bridges et al. | 81/3.8 |
| 4,321,575 | 3/1982 | Koszewa et al. | 81/3.8 |

*Primary Examiner*—Johnny D. Cherry
*Attorney, Agent, or Firm*—Z. T. Wobensmith, III

[57] ABSTRACT

Apparatus for remote closing of fuse circuits for overhead power lines is described which has a body fabricated of insulating material for detachable engagement with a fuse tube, the apparatus having a handle with a head thereon extending therefrom with a cord attached thereto and extending to the ground.

The handle is positioned in the apparatus and the cord pulled for swinging the fuse tube so that the fuse tube is moved to a position for closing a circuit, thereby rendering it unnecessary to close a transformer or tip switch from the pole or from a bucket truck. The apparatus normally slides off the fuse tube in closed position but can be removed from the fuse tube by pulling the cord from the ground.

6 Claims, 5 Drawing Figures

APPARATUS FOR THE REMOTE CLOSING OF FUSE CIRCUITS

BACKGROUND OF THE INVENTION

1. Field of the Invention

This invention relates to apparatus for the remote closing of a circuit for overhead power lines.

2. Description of the Prior Art

The use of many of the switch devices now available for connecting electrical apparatus to overhead power lines can result in serious injuries to the linemen using such devices.

My prior patent application, Ser. No. 208,258, filed Nov. 19, 1980, now U.S. Pat. No. 4,450,425, discloses a device for remotely closing a circuit to an overhead power line, and while it performs satisfactorily, its use is a limited one, and it is not satisfactory for all installations.

Various structures have been proposed for closing circuits to overhead power lines, one of which is shown in the Mannen U.S. Pat. No. 2,936,193, which discloses a switch stick for manipulation and installation of fuses on overhead power lines, and which includes a shaft 10 described as of a length of about fifteen feet, about two inches in diameter, and intended for installing a fuse weighing approximately thirty-eight (38) pounds. The switch stick includes a rope operated carrier slidable along the stick for releasably supporting a fuse member, the stick having means at its upper end to engage a fuse mounting.

The Mannen structure is cumbersome and difficult to manipulate to remove or replace a fuse, is limited to the length of the shaft, and includes metal parts which can involve electrical hazards.

The Hubbard U.S. Pat. No. 3,810,060, shows a remote closing power load pickup device for moving a conductive switch member 14 to circuit closing position by pulling on a lanyard or cord 76 which is permanently attached to a lever arm 70, the lever arm 70 being attached by rivets 87 to the contact section 50 which carries the conductive switch member 14.

One requirement of the Hubbard structure is that it is necessary to initially climb a pole to install the device and then climb the pole a second time to remove the lanyard which complicates its installation.

It has also been proposed as shown in the magazine Electrical World, of May 1, 1980, published by McGraw Hill, P.O. Box 430, Hightstown, N.J. 08520, at pages 57 and 58, to employ a fuse holder of the type shown in the Mannen patent, and which fuse holder can be hooked into notched arms carried by an insulated support, and to mount a clamp thereon intermediate the ends of the fuse holder. The attachment takes from five to fifteen minutes to install. The clamp has an arm extending therefrom with a cord attached to the arm to swing the fuse holder to closed position. Thereafter by inserting a switching tool or stick, with or without a pig tail attachment, into an opening in a release lever and elevating the clamp the fuse holder can be swung to closed position. The clamp is then intended to snap free from the fuse holder.

A serious objection to the structure just described is that it is necessary to climb a pole to place the fuse holder into its notches, and then to climb the pole again to manipulate the hot line tool or stick for removal of the clamp from the fuse holder.

The apparatus of the present invention is simple and easy to use, is safe, and avoids the necessity for climbing a pole.

SUMMARY OF THE INVENTION

In accordance with the invention apparatus is provided for the remote closing of fuse circuits and in which a pivotally carried fuse tube, supported from an overhead power line has a body of insulating material detachably engaged therewith, the apparatus having a crank extending therefrom that is to be positioned and a cord extending to the ground for swinging the fuse tube to an upward position to close a circuit, the apparatus normally sliding off the fuse tube in closed position but also being removable by pulling the cord from the ground.

It is the principal object of the invention to provide apparatus for swinging a fuse tube to an upright position which apparatus is detachably carried thereon and actuated by pulling a cord attached to a handle, the cord being available for removal of the apparatus from the fuse tube after completion of the swinging movement of the fuse tube if desired.

It is a further object of the invention to provide apparatus for swinging a fuse tube to a connecting position which has a high order of safety and which will reduce the climbing required by a lineman.

It is a further object of the invention to provide apparatus for use with a pivotally carried fuse tube which is simple and inexpensive to construct and which is reliable and safe in operation.

It is a further object of the invention to provide apparatus for the purposes referred to which can be readily attached and detached in a simple manner.

It is a further object of the invention to provide apparatus of the character aforesaid which does not present a safety hazard to the user.

Other objects and advantageous features will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
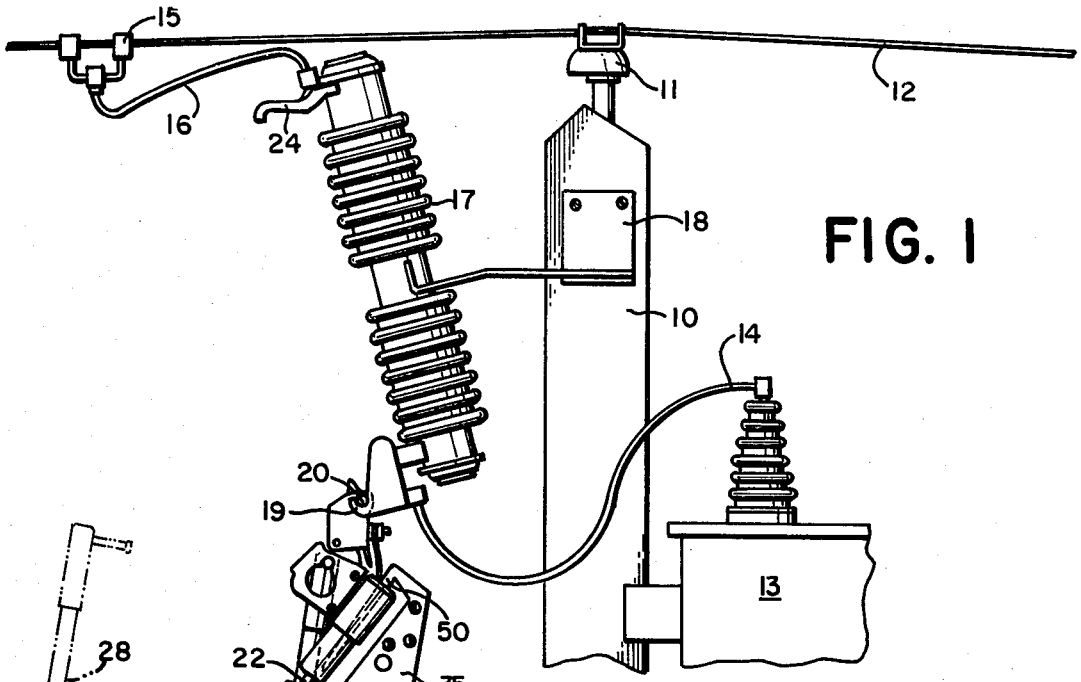
FIG. 1 is a view in elevation of the apparatus of the invention and showing the mounting of the fuse tube.
Figure 2:
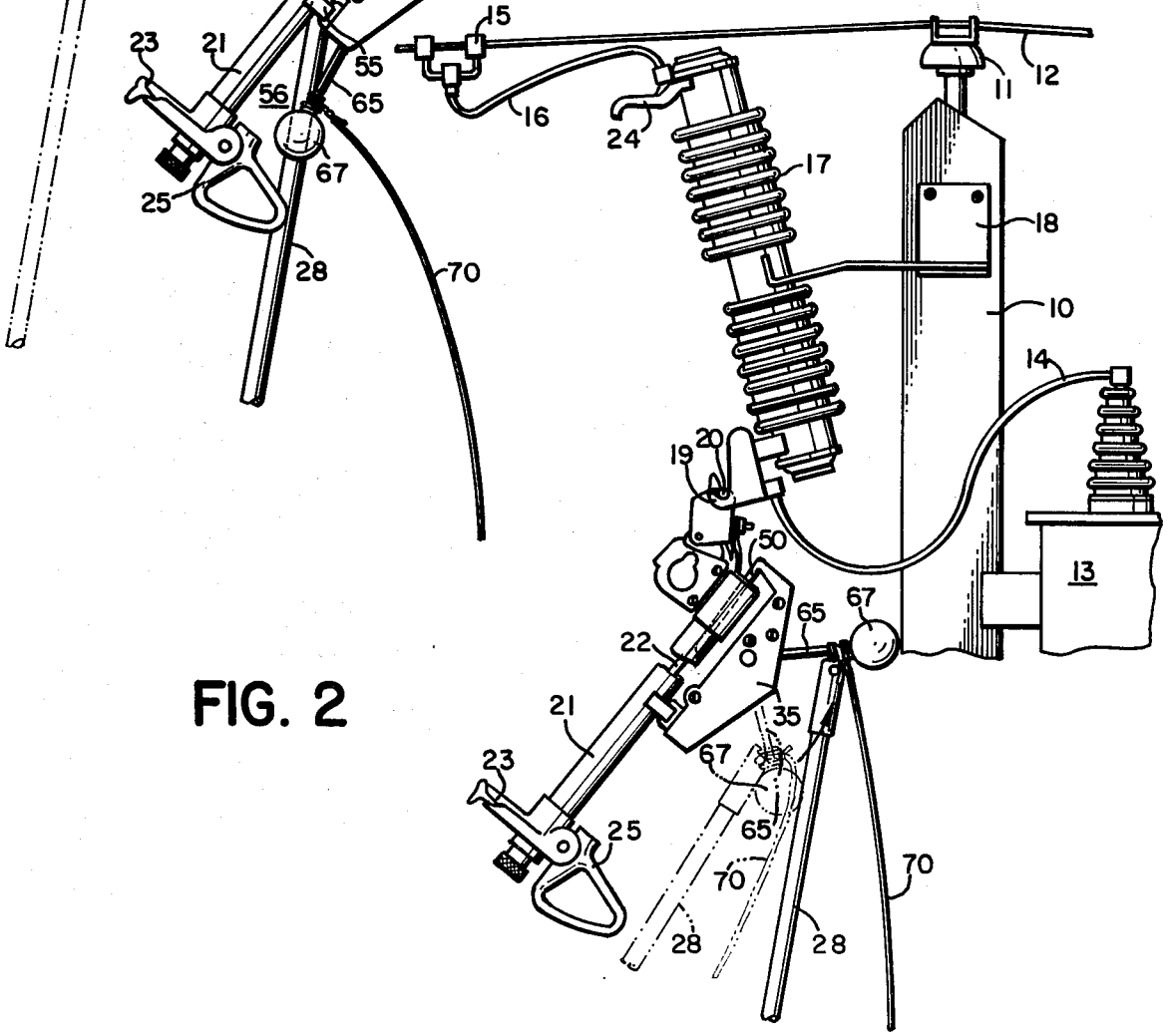
FIG. 2 is a view similar to FIG. 1 showing the apparatus being moved to operating position.
Figure 3:
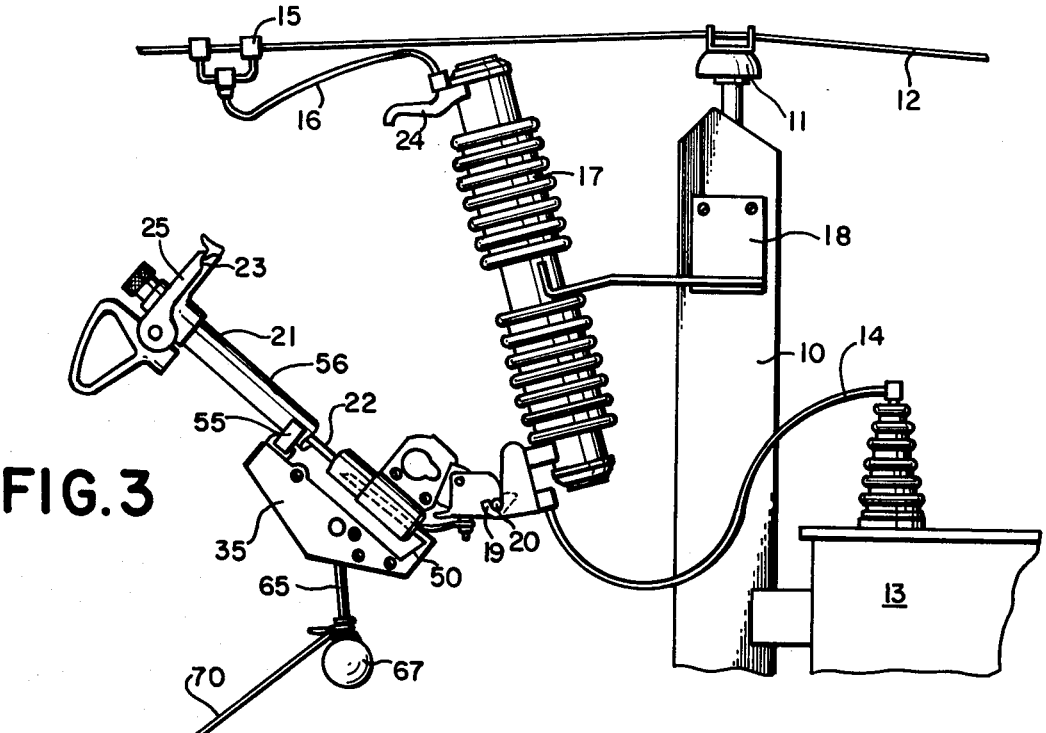
FIG. 3 is a view similar to FIG. 2 but showing the fuse tube in partially raised position.
Figure 4:
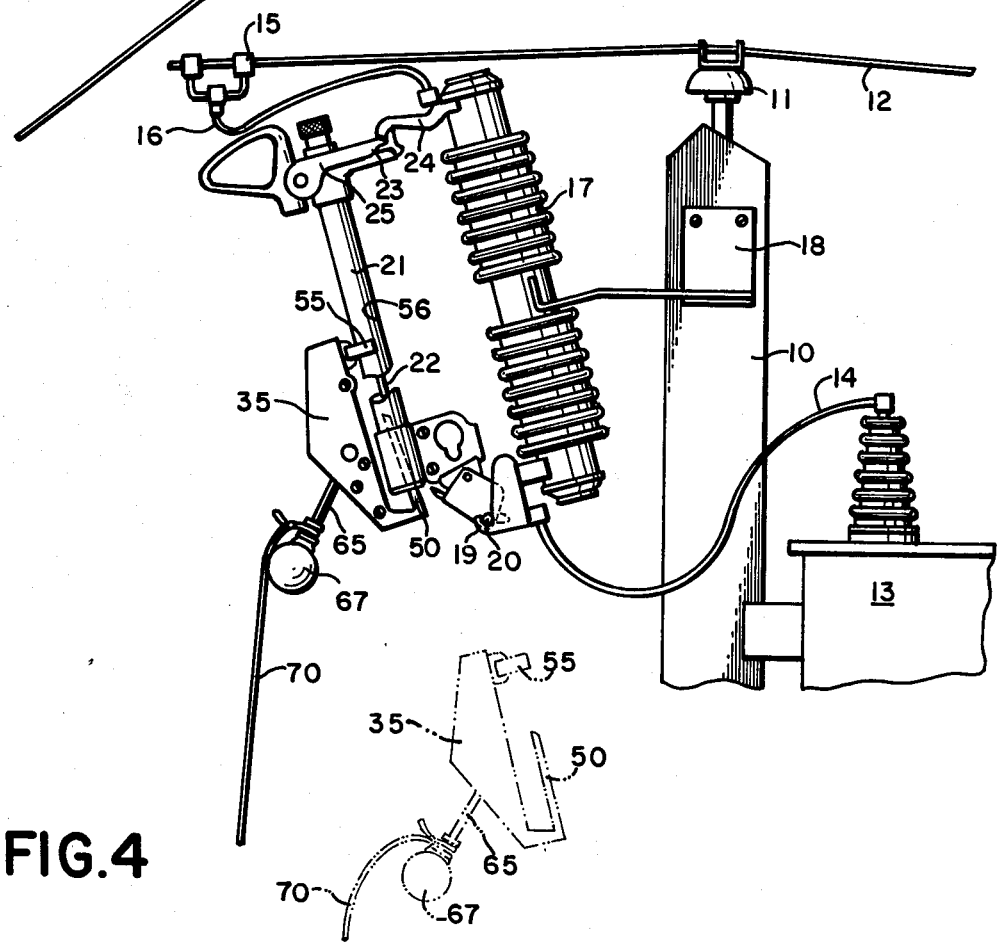
FIG. 4 is a view similar to FIG. 3 showing the fuse tube in latched position and the apparatus in phantom falling to the ground.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings in which a preferred embodiment of the invention is illustrated a pole 10 is shown having an insulator 11 carried thereon for an overhead power line 12. The pole 10 is also shown as carrying electrical apparatus such as a high voltage transformer 13 for energization by the power line 12 through a conductor 14.

The power line 12 has a hot line clamp 15 thereon connected by a conductor 16 to an elongated insulated supporting body 17 which can also, if desired, be supported by a bracket 18 carried on the pole 10, or in any other desired manner.

The insulated supporting body 17 has, at the lower end thereof, spaced hooks 19 for the reception of pivot pins 20.

The pivot pins 20 are carried contiguous to one end of a conductive tubular switch member 21 pivotally carried on the hooks 19, which preferably is a fuse tube, and which has mounted therein a detachable fuse link 22 which will be melted in the event of an overload. The conductive switch member 21 has at the end opposite the pivot pins 20, an outwardly extending contact bar 23 for engagement with a contact bar 24 carried on the supporting body 17, and with which it is retained in engagement by a pivotally mounted latch 25 carried on the tubular switch member to complete a circuit from line 12 to conductor 14. The latch 25 is releasable, if desired, by movement of a handle 26 with a hot line tool or stick 28.

The apparatus 35 used to swing up the tubular switch member or fuse tube 21 to latched position includes a body portion 40 of electrically insulating material and preferably of moldable synthetic plastic material.

Figure 5:
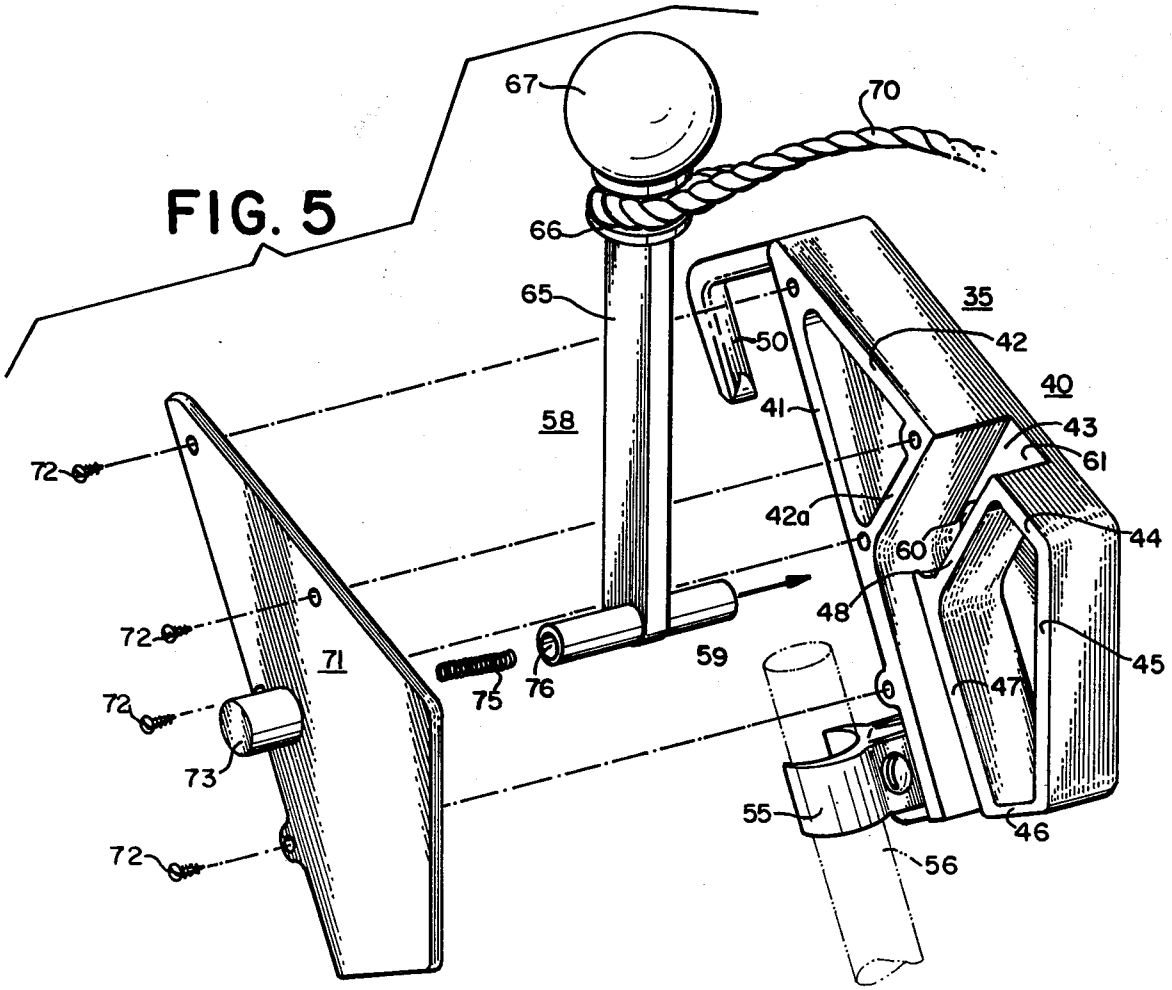
FIG. 5 is an exploded perspective view, enlarged, of the apparatus of the invention.

The body portion 40 is shown in detail in FIG. 5 and is of triangular shape with a straight left hand side wall 41, side wall 42 connected to side wall 41 at an approximate 45° angle extending to wall **42*a* forming the uppermost edge of a cut out 43. Adjacent the cut out 43 a straight wall portion 44 is provided with an angularly related wall portion 45 extending therefrom to a wall portion 46 which has a wall portion 47 connected thereto extending upwardly parallel to wall 41 spaced inwardly therefrom and having a wall portion 48 connected thereto and extending to wall portion 44 providing the lowermost edge of cut out 43. The wall portions 44, 45, 46, 47 and 48 are of a lesser height than the walls 41 and 42. At the intersection of the walls 41 and 42 a hook 50 is provided which is of L shape and capable of insertion into the fuse tube 21**.

The apparatus 35 is also provided with a clamp 55 which is secured to the wall 41 adjacent its lower end and capable of detachable engagement with the exterior surface 56 of fuse tube 21.

A crank 58 is provided which has a shaft 59 which can be inserted in a hole 60 in the bottom wall 61 adjacent walls 41 and **42*a*. The crank 58 has a handle 65 extending from shaft 59 with a collar 66 and head 67 thereon. The collar 66 has a cord 70 attached thereto for movement of handle 65** to be described below.

The body portion 40 has a cover plate 71 of generally triangular configuration and is attached to the body portion 40 by a plurality of screws 72, and which includes a boss 73 which can receive the shaft 59, and a spring 75 which is carried in a recess 76 in shaft 59 and urges the shaft towards body portion 40.

The mode of operation will now be pointed out.

In use, the fuse tube 21, has the hook 50 of apparatus 35 inserted therein adjacent the fuse link 22, and the clamp 55 snapped onto the exterior surface 56 of fuse tube 21.

The fuse tube 21 with apparatus 35 thereon is engaged by the end of the hot line tool 28 and the pins 20 engaged with the spaced hooks 19. The crank 58 is engaged by the end of the hot line tool 28 and moved along wall portion 45 and 44 until it reaches the cut out 43 where it is urged therein by spring 75 and locks into cut out 43.

The cord 70 is pulled from the ground by the lineman and the switch member 21 is swung upwardly to engage the contact bars 23 and 24 for retention by latch 25.

The apparatus 35 will normally slide off the fuse tube 21, however, if it sticks then it can be removed by pulling sharply on the cord 70.

It will thus be seen that apparatus has been provided with which the objects of the invention are achieved.

I claim:

1. Apparatus for remote closing of a pivotally mounted fuse carrying switch member which has an open end, is carried by an insulating support, and which has latching members for retaining said switch member in operating position which comprises a body portion for detachable engagement with said switch member, said body portion having a hook for insertion in said switch member open end, a clamp for engagement with the exterior of said switch member, a crank means extending from said body portion for positioning in said body portion for operation of said apparatus, and a cord connected to said crank means for moving said apparatus and the switch member to operating position.

2. Apparatus as defined in claim 1 in which said body portion of said apparatus is formed of electrically insulating material.

3. Apparatus as defined in claim 2 in which said body portion is formed of molded synthetic plastic.

4. Apparatus as defined in claim 1 in which said apparatus may be removed from said switch member in engaged position by pulling on said cord.

5. Apparatus as defined in claim 1 in which said body portion is of multi-piece construction which includes a cover plate, and a boss in said cover plate.

6. Apparatus as defined in claim 5 in which said crank means includes a crank pivotally mounted on a shaft carried in said body portion and in said boss, a spring carried by said shaft which urges said shaft and said crank towards said body portion, a cut-out in said body portion into which said crank can be positioned by rotation and locked by said spring for operation of said apparatus to close said switch member to operating position.

* * * * *